US008136608B2

(12) United States Patent
Goodman

(10) Patent No.: US 8,136,608 B2
(45) Date of Patent: Mar. 20, 2012

(54) MITIGATING PERFORATING GUN SHOCK

(75) Inventor: Kenneth Goodman, Richmond, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 12/336,494

(22) Filed: Dec. 16, 2008

(65) Prior Publication Data

US 2010/0147519 A1 Jun. 17, 2010

(51) Int. Cl.
*E21B 43/116* (2006.01)

(52) U.S. Cl. ..... 175/4.54; 166/297

(58) Field of Classification Search ..... 166/297; 175/1–4.55

See application file for complete search history.

(56) References Cited

U.S. PATENT DOCUMENTS

| | | | | |
|---|---|---|---|---|
| 2,154,768 | A * | 4/1939 | Otis | 417/142 |
| 3,163,112 | A * | 12/1964 | Rhea | 102/310 |
| 3,709,294 | A | 1/1973 | Kilgore | |
| 3,923,105 | A | 12/1975 | Lands | |
| 3,923,106 | A | 12/1975 | Bosse | |
| 3,923,107 | A | 12/1975 | Dillard | |
| 5,067,568 | A | 11/1991 | Yates | |
| 5,088,557 | A | 2/1992 | Ricles | |
| 5,366,013 | A * | 11/1994 | Edwards et al. | 166/297 |
| 6,412,415 | B1 | 7/2002 | Kothari | |
| 6,460,463 | B1 | 10/2002 | Parrott | |
| 6,523,474 | B2 | 2/2003 | Parrott | |
| 7,451,819 | B2 * | 11/2008 | Chang et al. | 166/299 |
| 2004/0168805 | A1 | 9/2004 | Fripp | |
| 2004/0231840 | A1 * | 11/2004 | Ratanasirigulchai et al. | 166/259 |

FOREIGN PATENT DOCUMENTS

| | | |
|---|---|---|
| EP | 488875 | 1/1997 |
| GB | 2277762 | 11/1994 |
| GB | 2375383 | 11/2002 |
| GB | 2390626 | 1/2004 |
| GB | 2430686 | 4/2007 |
| WO | 0158832 | 8/2001 |
| WO | 2007036722 | 4/2007 |

* cited by examiner

*Primary Examiner* — Daniel P Stephenson
*Assistant Examiner* — Kipp Wallace
(74) *Attorney, Agent, or Firm* — Chadwick A. Sullivan; Rodney Warfford

(57) ABSTRACT

A wellbore tool string includes a perforating gun having a plurality of explosive perforating charges and a shock mitigation tool. The shock mitigation tool including a tubular body having a top end, a bottom end, and a chamber; a barrier disposed proximate the bottom end in communication with the chamber; and a plurality of actuators connected with the body proximate to the top end of the body, each actuator opening a port in the body providing fluid communication with the chamber when the plurality of actuators are activated.

19 Claims, 1 Drawing Sheet

MITIGATING PERFORATING GUN SHOCK

TECHNICAL FIELD

The present application relates in general to wellbore operations and more specifically to systems and methods for mitigating the shock from perforating gun detonations in a wellbore.

BACKGROUND

Perforating guns are utilized in subterranean wells to create perforating tunnels to promote fluid communication between the wellbore and the surrounding subterranean formation. One drawback of perforating guns is that the shock from the detonated explosive charges can damage downhole equipment.

SUMMARY

Accordingly, methods, apparatus, devices and systems for mitigating the shock from detonated perforating charges are provided. One embodiment of a method for mitigating the shock from the detonation of a perforating charge in a subterranean wellbore includes the steps of disposing a mitigation tool in the wellbore; detonating the perforating charge in the wellbore; and activating the mitigation tool to create a fluid hammer.

An embodiment of a wellbore tool includes a tubular body having a top end, a bottom end, and a chamber; a barrier disposed proximate the bottom end in communication with the chamber; and an actuator connected with the body, the actuator opening a port in the body providing fluid communication with the chamber when activated.

An embodiment of a wellbore tool string includes a perforating gun having a plurality of explosive perforating charges and a shock mitigation tool. The shock mitigation tool including a tubular body having a top end, a bottom end, and a chamber; a barrier disposed proximate the bottom end in communication with the chamber; and at least one actuator connected with the body proximate to the top end of the body, the at least one actuator opening at least one port in the body providing fluid communication with the chamber when the at least one actuator is activated.

The foregoing has outlined some of the features and technical advantages of the present application in order that the detailed description that follows may be better understood. Additional features and advantages will be described hereinafter which form the subject of the claims.

BRIEF DESCRIPTION OF THE DRAWINGS

The foregoing and other features and aspects will be best understood with reference to the following detailed description, when read in conjunction with the accompanying drawings, wherein.

DETAILED DESCRIPTION

Figure 1:
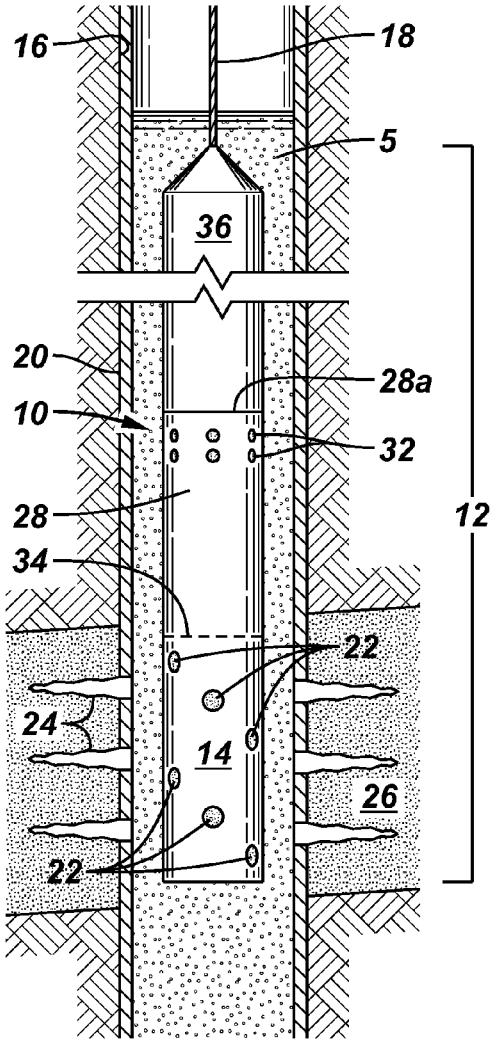
FIG. 1 is a wellbore schematic illustrating an embodiment of a perforating gun shock mitigation device.

Refer now to the drawings wherein depicted elements are not necessarily shown to scale and wherein like or similar elements are designated by the same reference numeral through the several views.

As used herein, the terms "up" and "down"; "upper" and "lower"; and other like terms indicating relative positions to a given point or element are utilized to more clearly describe some elements of the embodiments. Commonly, these terms relate to a reference point as the surface from which drilling operations are initiated as being the top point and the total depth of the well being the lowest point.

FIG. 1 is a well schematic illustrating an embodiment of a shock mitigation tool, generally denoted by the numeral 10, connected within a tool string 12. In the illustrated embodiment, tool string 12 includes mitigation tool 10 and a perforating gun 14. Tool string 12 is illustrated disposed in wellbore 16 on a conveyance 18. Wellbore 16 is completed with casing 20. In FIG. 1, mitigation tool 10 is disposed in wellbore fluid 5. Wellbore fluid 5 is a liquid and may comprise reservoir produced fluids, drilling mud, water and the like.

Perforating gun 14 includes a plurality of shaped perforating charges 22. Perforating gun 14 is fired, detonating perforating charges 22 creating tunnels 24 through casing 20 and into the surrounding subterranean formation 26. Tunnels 24 are created to promote fluid communication between wellbore 16 and formation 26. In some circumstances, the desired gun 14 configuration can cause damage to wellbore equipment, including well completion systems and tool string equipment, upon firing of perforating charges 22. This can be of particular concern when long guns are desired to shoot an extended portion of the well.

Figure 2:
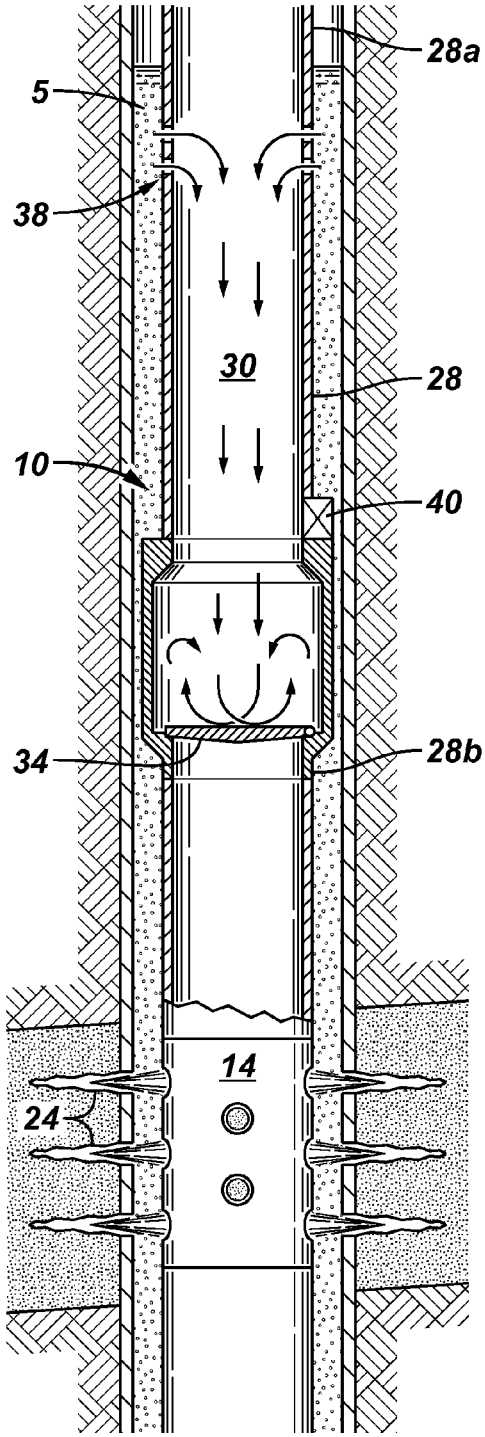
FIG. 2 is wellbore schematic illustrating another embodiment of a perforating gun shock mitigation device.

Tool string 12 includes mitigation tool 10 to provide a fluid dampening of the shock produced from the firing of gun 14. In the embodiment of FIG. 1, mitigation tool 10 comprises a body 28, internal chamber 30, an actuator 32 and a barrier 34. Actuator 32 is described as an explosive with reference to the FIGS. 1 and 2 herein. However, it is noted that actuator 32 may include other devices and combinations of elements that are adapted to form or open ports 38 (FIG. 2). For example, actuator 32 may comprise explosives, cutters, valves, sliding sleeves and the like.

In the illustrated embodiment, mitigation tool 10 is illustrated as positioned adjacent to perforating gun 14. However, it is noted that mitigation tool 10 may be spaced apart from gun 14 in some embodiments. It will also be seen that more than one mitigation tool 10, or mitigation tool section, may be provided in tool string 12.

Body 28 provides an internal chamber 30, illustrated in FIG. 2. In some embodiments, chamber 30 will be empty of liquids prior to mitigating tool 10 being activated. In one embodiment, body 28 is formed from a gun carrier. Other embodiments include a desired length of a tubular. Body 28 has a top end 28*a* and a bottom end 28*b*. Top and bottom ends 28*a*, 28*b* may be determined relative to the Earth's surface, but more specifically herein in relation to the direction of gravity. In this embodiment, mitigation tool 10 is positioned above gun 14. It should be noted that the configuration could essentially be reversed to provide shock mitigation in an opposite direction. Also, for horizontal wells the position of the mitigation tool and it's configuration could be modified appropriately, e.g., at either side of the gun 14 and to produce force in either direction.

One or more actuators 32 are positioned proximate to top end 28*a*. Actuators 32 are adapted to open ports 38 (FIG. 2) through body 28 upon activation. Actuators 32 may be provided by various devices. In the illustrated embodiments, actuators 32 are explosives. Explosives 32 may or may not be shaped charges. In the illustrated embodiment, a detonator 36 is in operational connection with explosives 32 and may also be in operational connection with perforating charges 22.

Barrier 34 is positioned proximate to bottom end 28*b*. Barrier 34, in some embodiments, may be moved between a closed position blocking passage through the bore of tool string 12 and an open position. In other embodiments, barrier 34 may be fixed in a closed or blocking position.

FIG. 2 is a conceptual view of a portion of an embodiment of mitigation tool 10 after activation. Operation of mitigation tool 10 is now described with reference to FIGS. 1 and 2. Prior to activation of mitigation tool 10, and the activation of gun 14, chamber 30 of mitigation tool 10 is empty of liquids and barrier 34 is in the closed position as shown in FIG. 2. In the illustrated embodiment barrier 34 is a valve. However, the barrier 34 could be other than a valve, for example, a solid piece of material fastened into place as noted above. The barrier 34, in any event, could contain an opening for passage a detonating cord (not shown). Barrier 34 may include an actuator 40 for selectively moving barrier 34 between the closed and open positions.

Mitigation tool 10 is activated, or fired, in response to the firing of gun 14 and detonation of perforating charges 22. Mitigation tool 10 may be fired at a selected delay after detonation of perforating charges 22, substantially simultaneous with firing of gun 14, or prior to firing gun 14 and the detonation of perforating charges 22. Upon activation of mitigation tool 10, actuators 32 form ports 38 (FIG. 2) through body 28. Upon the opening of ports 38, wellbore fluid 5 enters the empty chamber 30 and impacts barrier 34. The impact of fluid 5 on barrier 34 causes a pressure surge, or wave, dampening the shock from the detonation of perforating charges 22. The fluid dampening may be referred to from time to time herein as fluid hammer.

The volume of chamber 30 may vary, as desired, to achieve a desired amount of force generated by the fluid hammer. In some embodiments, actuators 32 are selected to open one or more ports 38 that create an area of flow substantially equal to the cross-sectional area of chamber 30. Additionally, the distance between actuators 32, and therefore ports 38, and barrier 34 may vary between installations to change the force of fluid 5 striking barrier 34.

From the foregoing detailed description of specific embodiments, it should be apparent that methods and devices for mitigation perforating shock that are novel have been disclosed. Although specific embodiments have been disclosed herein in some detail, this has been done solely for the purposes of describing various features and aspects, and is not intended to be limiting with respect to the scope of the claims. It is contemplated that various substitutions, alterations, and/or modifications, including but not limited to those implementation variations which may have been suggested herein, may be made to the disclosed embodiments without departing from the spirit and scope defined by the appended claims which follow.

What is claimed is:

1. A method for mitigating the shock from the detonation of a perforating charge in a subterranean wellbore, the method comprising:

disposing a mitigation tool in the wellbore and within the wellbore liquid, the mitigation tool comprising a tubular body forming a chamber empty of liquid and a barrier disposed in the chamber proximate the bottom end of the mitigation tool;

detonating the perforating charge in the wellbore;

activating the mitigation tool to dampen the detonation shock in the wellbore, comprising opening a port between the wellbore liquid and the chamber a distance above the barrier;

selecting the distance between the port and the barrier to achieve an impacting force sufficient to create a desired mitigating pressure wave; and impacting the wellbore liquid on the barrier positioned in the elongated chamber with the impacting force creating the mitigating pressure wave in the wellbore, wherein the mitigating pressure wave dampens the detonation shock in the wellbore, wherein the barrier is a valve member moveable between an open position and a blocking position.

2. The method of claim 1, wherein the mitigation tool is positioned in the wellbore above the perforating charge.

3. The method of claim 1, wherein the detonating the perforation charge and the activating the mitigation tool are performed substantially simultaneously.

4. The method of claim 1, wherein the activating the mitigation tool is performed subsequent to the detonating the perforating charge.

5. The method of claim 1, further comprising:

disposing a second mitigation tool in the wellbore; and activating the second mitigation tool, wherein the first mitigation tool and the second mitigation tool are activated at different times.

6. The method of claim 1, wherein the mitigation tool comprises an actuator connected with the tubular body, the actuator opening the port through the tubular body.

7. The method of claim 6, wherein the actuator is an explosive.

8. The method of claim 6, wherein the actuator comprises a plurality of actuators, each of the plurality of actuators opening a port through the tubular body and into the chamber when activated.

9. The method of claim 8, wherein the plurality of ports together have a cross-sectional area substantially equal to the cross-sectional area of the chamber.

10. The method of claim 1, wherein the port has a cross-sectional area approximately that of the cross-sectional area of the chamber.

11. A wellbore tool string, the tool string comprising:

a perforating gun having a plurality of explosive perforating charges; and a shock mitigation tool comprising:

a tubular body having a top end, a bottom end, and a chamber;

a valve having a barrier disposed proximate the bottom end in communication with the chamber, wherein the barrier is operational between an open position and a blocking position; and at least one actuator connected with the tubular body proximate to the top end of the tubular body, the at least one actuator opening at least one port in the tubular body providing fluid communication with the chamber when the at least one actuator is activated, wherein the port is located a distance above the barrier such that when the barrier is in the blocking position a fluid entering the chamber through the port impacts the barrier with a force to cause a pressure wave to dampen the shock of the detonated explosive perforating charges.

12. The tool string of claim 11, comprising a plurality of actuators, the actuators comprising explosive charges.

13. The tool string of claim 11, wherein the at least one port has a total combined cross-sectional area substantially equal to a cross-section area of the chamber.

14. A method for mitigating the shock from the detonation of a perforating charge in a subterranean wellbore, the method comprising the steps of:

disposing a mitigation tool in the wellbore and within the wellbore liquid, the mitigation tool comprising a tubular body forming a chamber empty of liquid and a barrier disposed in the chamber proximate the bottom end of the mitigation tool, wherein the barrier is a valve member moveable between an open position and a blocking position;

detonating the perforating charge in the wellbore;

activating the mitigation tool to dampen the detonation shock in the wellbore, comprising opening a port between the wellbore liquid and the chamber a distance above the barrier; and impacting the wellbore liquid on the barrier positioned in the elongated chamber with a force creating a mitigating pressure wave in the wellbore, wherein the mitigating pressure wave dampens the detonation shock in the wellbore.

15. The method of claim 14 wherein the port has a cross-sectional area approximately that of the cross-sectional area of the chamber.

16. The method of claim 14, wherein the port comprises a plurality of openings.

17. The method of claim 14, wherein the activating the mitigation tool is performed subsequent to the detonating the perforating charge.

18. The method of claim 14, wherein the mitigation tool comprises an actuator connected with the tubular body, the actuator opening the port through the tubular body.

19. The method of claim 18, wherein the actuator is an explosive.

* * * * *